United States Patent [19]

Grindstaff et al.

[11] Patent Number: 5,069,846

[45] Date of Patent: Dec. 3, 1991

[54] PROCESS FOR PREPARING DRAWN FILAMENT YARNS

[75] Inventors: Teddy H. Grindstaff; Cecil E. Reese, both of Kinston, N.C.

[73] Assignee: E. I. Du Pont de Nemours and Company, Wilmington, Del.

[21] Appl. No.: 420,456

[22] Filed: Oct. 12, 1989

Related U.S. Application Data

[63] Continuation-in-part of Ser. No. 228,801, Jul. 28, 1988, abandoned, which is a continuation of Ser. No. 934,219, Nov. 21, 1986, abandoned.

[51] Int. Cl.[5] ..... D01F 6/62; D01F 11/04

[52] U.S. Cl. ..... 264/103; 264/129; 264/130; 264/134; 264/136; 264/210.3; 264/210.8; 264/233; 264/211.14; 264/211.15

[58] Field of Search ..... 264/211.14, 129, 103, 264/130, 134, 136, 210.3, 210.8, 233, 211.15

[56] References Cited

U.S. PATENT DOCUMENTS

| | | | |
|---|---|---|---|
| 3,110,617 | 11/1963 | Scott | 407/175 |
| 4,316,724 | 2/1982 | Minemura et al. | 428/89 |
| 4,396,389 | 8/1983 | Löffren | 8/115.5 |

FOREIGN PATENT DOCUMENTS

| | | |
|---|---|---|
| 3324662 | 7/1982 | Fed. Rep. of Germany . |
| 1189299 | 10/1959 | France . |
| 47-35608 | 9/1972 | Japan . |
| 49-1257 | 1/1974 | Japan . |
| 55-4845 | 2/1980 | Japan . |
| 56-31073 | 3/1981 | Japan . |
| 56-140167 | 11/1981 | Japan . |
| 58-169512 | 12/1983 | Japan . |
| 58-180672 | 1/1984 | Japan . |
| 61-231218 | 3/1987 | Japan . |
| 839456 | 6/1960 | United Kingdom . |
| 850169 | 9/1960 | United Kingdom . |
| 1093628 | 12/1967 | United Kingdom . |
| 1276329 | 6/1972 | United Kingdom . |

OTHER PUBLICATIONS

Herman Ludewig, Polyester Fibres–Chemistry and Technology 1964, Engl Transl 1971, John Wiley & Sons Ltd, pp. 387–389.

*Primary Examiner*—Hubert C. Lorin

[57] ABSTRACT

Drawn polyester multi-filament yarns, preferably prepared by a coupled process of spin-drawing, and of fabrics and garments thereof, are prepared by an improved process involving treatment of freshly-extruded polyester filaments with caustic in the spin-finish, so as to improve moisture-wicking properties.

3 Claims, No Drawings

PROCESS FOR PREPARING DRAWN FILAMENT YARNS

CROSS-REFERENCE TO RELATED APPLICATIONS

This application is a continuation-in-part of copending application Ser. No. 07/228,801, filed July 28, 1988, now abandoned, which itself is a continuation of application Ser. No. 06/934,219, filed Nov. 21, 1986, now abandoned.

TECHNICAL FIELD

This invention concerns improvements in and relating to drawn multi-filament yarns of the polyester type, and more particularly to such yarns whose filaments are modified to provide entirely new properties, and including textile articles such as fabrics and garments containing such yarns and filaments.

BACKGROUND OF THE INVENTION

Synthetic polyester yarns have been known and used commercially for several decades, having been first suggested by W. H. Carothers, U.S. Pat. No. 2,071,251, and then by Whinfield and Dickson, U.S. Pat. No. 2,465,319. The polyester yarns that have been manufactured and used hitherto have constituted essentially two general categories, (1) spun yarns of cut or staple fiber twisted together like cotton, for example and (2) multifilament yarns. This application is not concerned with yarns spun only from cut fiber, such as are covered in copending application Ser. No. 07/420,457, filed simultaneously herewith, but with filament yarns, i.e. yarns of category (2) comprising continuous filaments, which themselves presently constitute two further categories, (a) undrawn yarns, which have been mainly draw-texturing feed yarns (often termed POY) that are further processed (DTFY is draw-textured) because their properties are not yet suitable to permit use in forming most fabrics, and (B) drawn yarns. This application is concerned only with multi-filament yarns of category (B), i.e. drawn yarns, that are suitable for use directly in fabric construction, e.g. by knitting or weaving. These yarns do not need a preliminary treatment to change important filamentary characteristics, such as modulus, because these yarns have already been drawn by a conventional process to increase their modulus. Such drawn yarns fall into essentially two categories, according to their method of preparation. In the 1950's, drawn polyester filament yarns were made commercially only by a split process, involving first melt-spinning (i.e. extruding molten polyester into solid filaments) at a relatively low (withdrawal and wind-up) speed to make an unstable undrawn yarn of low orientation that was wound onto a package, and then this package of undrawn yarn was unwound and subjected to a separate drawing operation to increase orientation and crystallinity and thereby make stable yarns of low shrinkage that could be used in textile operations, such as weaving and knitting. This process is called the split process to distinguish from the later coupled process, in which the two separate steps of spinning and drawing are combined into a continuous process, i.e. without intermediate wind-up, as disclosed, e.g. by Chantry et al. in U.S. Pat. No. 3,216,187. The coupled spin-draw process has been used by Du Pont on a commercial scale for more than 20 years with high speed winders capable of operation at speeds of 3–4 km/min, and we consider it far preferable over the older split process for technical reasons, but the split process may still be operated in some parts of the world. The coupled process produces more uniform products, because the unstable undrawn yarn is immediately drawn, without time for significant change in properties, and because all portions of each yarn have an identical history. In recent years, it has been shown that the original coupled process can be modified by increasing the speed of withdrawal of undrawn filaments, with the result that even the undrawn intermediate filaments (that are not wound-up) are stable to heat, for example.

Drawn polyester multi-filament yarn has been recognized as having significant advantages over cotton yarns in some respects, for instance its thermoplastic characteristics that enable polyester-containing fabrics to hold their shape, for instance a crease, and to have wash-wear characteristics, its low cost of manufacture, its uniformity, its superior strength, and its resistance to degradation. However, hitherto, some people have expressed a preference for wearing garments from cotton fibers because of attributes that can be summarized as "comfort", to the extent that there has been a trend recently towards using more 100% cotton fabrics, despite the practical advantages of wash-wear 100% polyester fabrics. Because of the sophistication of the textile industry, both of the polyester fiber manufacturing industry and of downstream consumers of textiles, and because of the commercial interest in providing apparel and fabrics that will perform well during actual use by the ultimate consumer (wearer), much attention has been devoted to analyzing appropriate requirements. Many technical papers, for example, have been published on various aspects, and patents have been issued with the objective of improving the "comfort" that can be obtained from textile articles, and their constituents, and the literature has been replete with these suggestions for several years. So it has long been considered desirable to improve various properties of textiles prepared from drawn multi-filament polyester yarns, and much effort has been devoted in the textile industry towards this objective.

An important objective of our invention is to provide such polyester drawn multi-filament feed yarns and filaments in a new form, which can be formed into fabrics and garments that can show improved moisture-wicking properties, as discussed herein.

Polyester filaments are characterized by their extreme hydrophobic character, as mentioned in "Polyester Fibres—Chemistry and Technology", by H. Ludewig—English translation 1971—John Wiley and Sons, Ltd., in Section 11.1.5 on pages 377–378, and also in Section 11.4 on dyeing properties, starting on page 398. Indeed, the difficulty of dyeing polyester yarns and fabrics is notorious. Ludewig's book mentions many aspects of polyester fibers and their preparation and properties.

It is conventional to coat all freshly-extruded filaments with a "finish", which is generally an aqueous emulsion comprising a lubricant and an antistat. Finishes are discussed briefly in Section 5.5, starting on page 193, of Ludewig, referred to above. As mentioned on page 195, the literature reveals relatively little about the compositions of the spin-finishes that are actually used. Although there is now considerable patent and other literature, the precise finish formulations are generally closely-guarded secrets by the yarn manufacturers, and different compositions are formulated for different purposes, depending on the particular intended processing and possible specific requests by individual customers, and these formulations change, sometimes quite frequently. As will be related hereinafter, a dramatic change in the surface properties of the filaments of the eventual drawn yarns, and of articles containing them, such as fabrics and garments, may be obtained by a relatively simple modification to the spin-finish that is applied to the freshly-extruded polyester undrawn filaments. Conventionally, the spin-finish is the first contact that a freshly-extruded filament encounters after solidification. The finish was generally applied by a finish roll, rotating in a bath of the finish, so that the filaments pass through the finish emulsion as they brush past the finish roll on their way from the solidification zone to the feed roll that determines the withdrawal speed from the spinneret. Before the finish roll, it is generally desirable to avoid or minimize contact between the filaments and solid objects, and so the only other closely-adjoining solid objects are generally guides that are intended to confine the filaments before contacting the finish roll. A finish roll is not the only method of applying finish, and other methods have been used and suggested, including spraying or metering the finish onto the filaments.

SUMMARY OF THE INVENTION

According to the present invention, the moisture-wicking properties of drawn polyester filaments and yarns in textile fabrics and garments can be significantly changed by adding a small amount of caustic to the spin-finish, so that the caustic can modify the surface of the filaments as they are freshly extruded. This change has caused the polyester surface to be modified and have improved moisture-wicking properties, after washing. It is surprising that this long-desired improvement can be achieved by such a small change in the conventional process, and that this has not been reported hitherto, so far as I know, despite the many references in the literature to treatments, especially of fabric, with caustic soda among other materials.

Accordingly, there is provided an improvement in a process for preparing drawn multi-filament yarns, comprising the steps of melt-spinning polyester into filaments, treating the freshly-extruded filaments with a finish, collecting them in the form of a yarn and drawing to increase orientation and crystallinity, to reduce shrinkage, the improvement characterized by treating the freshly-extruded filaments so as to pick up a small amount of caustic, in sufficient amount and sufficiently rapidly so as to modify the surface of the polyester, so as to improve their moisture-wicking properties, after washing, and the resulting drawn yarns that are new and improved in that their polyester filaments have such modified surface that provides improved comfort to the new downstream articles, such as fabrics and garments that incorporate such yarns and filaments.

DETAILED DESCRIPTION OF THE INVENTION

For convenience, despite the fact that the surface has been changed, so that the moisture-wicking characteristics are not what has hitherto been associated with "polyester" filaments and yarns, we shall refer to both treated and untreated materials by the term "polyester", for reasons which will be apparent.

At this point, we refer to copending applications Ser. No. 07/420,457, Ser. No. 07/420,458 and Ser. No. 07/420,459 filed simultaneously herewith, because they describe corresponding surface-modification of polyester filaments during the preparation, respectively, of filamentary tows, staple fiber and spun yarn therefrom, DTFY and textured yarns therefrom and crystalline spin-oriented filaments and yarns, and because development of some of those technologies has proceeded further, and so the disclosures therein are incorporated by reference, because it is believed that essentially similar technical findings will apply to the present invention and textile materials herein, and because several comments and in particular tests and comparisons, and some aspects of thresholds and amounts, related therein, could apply to the polyester filaments treated according to the present invention, with, however, also a caution that, since an essential element of the invention concerns working with freshly-extruded filaments and a rate phenomenon, as disclosed therein, in other words since this is a freshly-exposed surface phenomenon, if the dimensions and quantities of the treated filaments are changed significantly, adjustments have had to be made to the quantities of caustic to achieve the same desired effect, as can be seen by a comparison of the working Examples in the various cases.

The preparation of the polyester drawn yarn may be carried out conventionally except for the application of caustic to the freshly-extruded filaments, and then the treated filaments may be processed conventionally, including drawing to form the drawn yarns, and eventually making fabrics, e.g. by knitting or weaving, and garments by conventional techniques. Such process will be described with particular reference to the coupled process that has been preferred, hitherto, and practiced by us. Generally, hitherto, undrawn polyester filaments have been prepared by melt-spinning, and the undrawn filaments have been drawn, treated with a spin-finish, collected into a bundle, interlaced, and wound up at high speeds of the order of 3–4 km/min. According to the invention, any such conventional drawing process is modified by treating the freshly-extruded filaments with caustic, such as caustic soda or caustic potash. As indicated, this may most conveniently be effected by adding an appropriate amount of caustic to the finish that is applied to the freshly-extruded filaments, since the application of finish is essentially the first treatment or contact that the freshly-extruded filaments encounter after solidification. It is important, according to the invention, that this treatment with caustic be effected on these freshly-extruded filaments, which are often referred to as "live" filaments, since the effect appears to be different from that obtained if caustic soda is applied at a later stage to fabrics, according to prior art teaching. If the application of a small amount of caustic is not sufficiently prompt, the caustic will not improve the moisture-wicking properties significantly, as discussed in the copending application referred to.

We believe that there has been a chemical change to the surface of the filament, from its regular hydrophobic nature, that has been a characteristic of polyester as reported, e.g. by Ludewig. The core appears to be relatively unchanged from regular polyester polymer, whereas the surface has been significantly changed so that the yarn, fabric and garments show improved moisture-wicking properties, after washing. Since the treatment is applied to the surface of the freshly-extruded filament, which is undrawn, and this filament is then subjected to a drawing process, in which the surface of the filament is significantly increased, which must mean that new surface is created from polymer that had previously been concealed beneath the surface of the undrawn filament, it is extremely surprising that the improvement in properties are shown in the fabrics and garments, that contain drawn material, whereas it was the undrawn filament that was treated with caustic. In order to obtain the improved properties, the filament surfaces must be washed, as described in the above-mentioned copending application Ser. No. 07/420,457. This usually occurs during normal processing, e.g. of the fabrics, but may apply at any stage of processing of the yarns.

Precautions need to be taken and modifications must probably be made to avoid or minimize corrosion or other contamination and other disadvantages that may result because of the use of caustic according to the invention. For such reasons, hitherto, it has been considered highly undesirable to include any dangerous or corrosive material, such as caustic, even in the small amounts indicated, at this stage of the process. This is at least one reason why, so far as we know, hitherto, there has previously been a prejudice against the use of a material such as caustic at this stage of a process for preparing a polyester drawn yarn. In this regard, it should be recognized that the filaments travel at such high speeds that it is difficult to avoid 'slinging', i.e., release of droplets of finish from these high speed filaments after application of the finish.

In copending application Ser. No. 07/420,457 caustic soda (NaOH) has been used, and in copending applications Ser. No. 07/420,458 and Ser. No. 07/420,459 caustic potash has been used to improve the moisture-wicking performance of polyester yarns, and fabrics thereof, so it is to be expected that other alkali metal hydroxides, alkaline earth metal hydroxides or equivalent basic materials may give an essentially equivalent effect.

As mentioned in copending application Ser. No. 07/420,457, fabrics and garments from the spun yarns in the Example therein are expected to provide soft, dry, cool and airy aesthetics, and more breathability, and that the hydrophilic surface-modified polyester is expected to give even more of the advantages where improved moisture-wicking as indicated by the polyester having at least 0.2 surface carboxyl equivalents per million grams, preferably at least 0.3 surface carboxyl equivalents per million grams, of drawn fiber, is important, such as coolness and dryness, (as compared with prior art polyester that has not been surface-modified). Similarly, fabrics and garments from drawn yarns and filaments according to the present invention are expected to show advantages where moisture-wicking is important.

The filaments may be of conventional deniers and other characteristics for making yarns and fabrics and garments therefrom, using conventional techniques. The filaments may be round or of any other cross-sections, such as scalloped-oval, or trilobal, if desired.

In addition to conventional polyester, i.e. poly(ethylene terephthalate) such as is used in the Examples of the copending applications mentioned above, other polyesters, such as copolymers, e.g. with cationic or other dye-modifiers, may be used, and changes may be made accordingly to correspond with such changes to the polymer, e.g. in the methods of preparation and testing. The advantage of the invention is that the normal hydrophobic surface is significantly changed by the simple treatment of freshly-extruded filaments with caustic according to the invention, and the invention is not considered restricted by the nature of the polyester polymer, nor by the cross-section or configuration of the filaments. Indeed, we believe that certain copolymers and special configurations may respond somewhat more easily to surface-modification.

We claim:

1. An improvement in a process for preparing drawn multi-filament yarns, comprising the steps of melt-spinning polyester into filaments that are quenched as they are withdrawn from the spinneret at a speed termed the withdrawal speed, treating the freshly-extruded filaments with a finish, collecting them in the form of a yarn and drawing to increase orientation and crystallinity, to reduce shrinkage, wherein the improvement consists in treating the freshly-extruded filaments with a spin-finish containing an amount of caustic selected and at a location selected such that, in combination with the withdrawal speed and quenching conditions, the caustic treatment is sufficiently soon so as to modify the surface of the polyester, so as to improve the moisture-wicking properties, when washed, as indicated by the polyester having at least 0.2 surface carboxyl equivalents per million grams of drawn fiber.

2. A process as claimed in claim 1, wherein the spinning and drawings steps are coupled to provide a drawn yarn that is wound up, with interlacing to improve coherency, and without intermediate winding of undrawn filaments.

3. A process according to claim 1 or 2, wherein the freshly-extruded polyester filaments are treated so that the polyester has at least 0.3 surface carboxyl equivalents per million grams of drawn fiber.

* * * * *